United States Patent [19]

Burchette, Jr.

[11] 4,050,646

[45] Sept. 27, 1977

[54] YARN CARRIER

[76] Inventor: Robert L. Burchette, Jr., 570 El Paso St., Spartanburg, S.C. 29303

[21] Appl. No.: 638,141

[22] Filed: Dec. 5, 1975

[51] Int. Cl.[2] ..... B65H 75/28

[52] U.S. Cl. ..... 242/125.1; 242/18 PW

[58] Field of Search ..... 242/125.1, 18 A, 18 PW, 242/18 EW, 125.2, 125, 118.1, 118.11, 118.3, 118.31, 118.32; 57/34 TT

[56] References Cited

U.S. PATENT DOCUMENTS

| | | | |
|---|---|---|---|
| 2,485,776 | 10/1949 | Roberts | 57/34 TT |
| 3,051,411 | 8/1962 | Atwood et al. | 242/125.1 |
| 3,138,345 | 6/1964 | Luber | 242/118.1 X |
| 3,141,631 | 7/1964 | Krebs | 242/118.3 |
| 3,717,291 | 2/1973 | Adams et al. | 242/125.1 |
| 3,814,347 | 6/1974 | Moren, Jr. | 242/125.1 |
| 3,827,652 | 8/1974 | Burchette, Jr. | 242/118.11 |
| 3,941,322 | 2/1976 | Hewitt | 242/18 A |

*Primary Examiner*—George F. Mautz

*Attorney, Agent, or Firm*—Wellington M. Manning, Jr.; Luke J. Wilburn, Jr.

[57] ABSTRACT

A yarn carrier is disclosed and claimed herein for primary use in an open end spinning operation and has improved means thereon to initiate preparation of the package and to produce an improved yarn transfer tail thereon. The carrier is generally a tubular cylinder and has at least one yarn receiving area thereon with an adjacent surface across which yarn will freely pass when yarn is received therein and the carrier is moved out of the yarn path. In a preferred arrangement, at least one yarn receiving slot is provided in one or both ends of the tube with a post along the outside of the slot across which the yarn may freely pass. Adjacent the bottom of the preferred yarn receiving slot, a groove that extends circumferentially around the cylinder is preferably provided to receive yarn therein for a transfer tail.

7 Claims, 8 Drawing Figures

YARN CARRIER

BACKGROUND OF THE INVENTION

Yarn carriers have been provided hereinbefore for the winding of yarn thereon in various and sundry arrangements to produce a yarn package. In recent years the advent of open end spinning has precipitated a use for small yarn carriers to receive the open end, spun yarn therearound. Emphasis has been placed on development of a small cylindrical carrier with an improved yarn transfer tail producing means to foster uninterrupted operation for winding and rewinding operations from the packages. Efforts have also been directed to the development of a yarn carrier which may be utilized in an open end spinning operation to better initiate preparation of the yarn package therearound.

In an open end spinning operation, spun yarn is passed along a path between feed rolls and a yarn waste suction system. As the yarn passes along the intended path, a yarn carrier is brought into contact therewith in such fashion that the yarn moves across the carrier and continues to be removed by the suction system. At an appropriate time, the yarn is engaged by wind initiator means on the carrier and the production of the package begins. Initially, the transfer tail is produced by yarn being withdrawn from the suction system. After an appropriate length of time, the yarn from the suction system is severed, and yarn traverse along the package proceeds in the normal fashion to wind the yarn around the carrier.

Prior art packages utilized in open end spinning operations have employed a plurality of ridges or grooves along the length of the carrier to prevent yarn from sloughing off the carrier. Various arrangements have been employed to engage the yarn during passage of the yarn into the suction system and start the production of the package. Slots have been employed while though similar in nature to the present arrangement, are much less efficient in snaring the yarn, and produce unnecessary waste and promote uneven package sizes. Prior art slots are generally two side by side openings in the end of the tube with the yarn following a tortuous path through both. The present invention represents an improvement over the prior art carriers, affording a carrier having improved means for initiation of production of the yarn package. The carrier of the present invention enables one to produce yarn packages at a material savings since the package is started in a more efficient fashion and less yarn waste is produced. More uniform packages also are the result of the carrier of the present invention. The present invention thus represents a definite advance in the art and is not taught or suggested by any known prior art.

SUMMARY OF THE INVENTION

An object of the present invention is to provide an improved yarn carrier.

Another object of the present invention is to provide an improved yarn carrier for an open end spinning operation.

Still another object of the present invention is to provide an improved yarn carrier that may also be utilized as a dye tube.

Yet another object of the present invention is to provide an improved collapsible yarn dye tube for use in production of yarn packages in an open end spinning operation.

Generally speaking, the yarn carrier of the present invention comprises a tubular cylindrical body, said body having at least one yarn receiving area thereon, said area having at least one adjacent surface that will permit yarn to pass freely thereacross, whereby said carrier can be brought into a yarn path when yarn passes into said yarn receiving area and said carrier can then be moved out of the yarn path, carrying the yarn therealong while said yarn moves freely across said surface until it is desirable to initiate production of a yarn package on said carrier.

More specifically, the yarn carrier of the present invention is a cylindrical tube where preferably, at least one yarn receiving slot has been provided on the tube. Generally, the slots are produced by cutting across an arc at the end of the cylinder, through end openings through the side wall of the tube, across from each other may define a slot, as well as notches along the length of the tube. A transfer tail receiving groove is also preferably provided adjacent the bottom of the slot and extending into the slot to permit yarn to immediately and automatically pass from the slot into the groove to produce an improved transfer tail thereat.

A plurality of yarn receiving slots are preferably provided in one or both ends of the carrier at a plurality of circumferentially spaced locations. Chances of engaging the yarn quickly during contact between the end of the package and the yarn passing between the feed rolls and the suction system are thus improved. In this regard, the yarn receiving slots may extend through opposite sides of the carrier side wall, or the slot may be produced such that the inside carrier wall is uninterrupted thereat.

The transfer tail groove that is preferably provided adjacent the bottom of the yarn receiving slot has a preferred structural arrangement. The groove is preferably large enough to receive several wraps of yarn therein. The width of the groove along the carrier is preferably greater than the depth of same. Moreover, in a preferred arrangement, one side wall of the groove is straight, being substantially perpendicular with respect to the surface of the carrier. Yarn of the transfer tail residing in the groove is thus precluded from easy sloughing out of the groove. An opposite side wall of the groove is tapered to foster ease of unwinding of the yarn from the package.

The cylinder side wall surface of the present invention may be structured as desired so long as the initial wraps of yarn do not slough off the cylinder as the package is being initiated. A plurality of very shallow grooves or ridges may be provided along the length of the tube to prevent sloughing off of the initial wraps. Likewise, the surface of the tube may be textured by sand blasting or the like to afford a roughened or nonuniform surface, or may be presented in such other fashion as will preclude yarn from sloughing off the package during production of same.

As mentioned above, the particular yarn package of the present invention may be solid along the length thereof. Likewise, the tube may be perforated to provide a yarn dye capability with the same yarn package that is produced in the spinning operation. Still further, the carrier may be axially collapsible for further improved yarn dye operations. Any of the collapsible yarn dye tubes may be adapted according to the present invention. Preferred collapsible yarn dye tubes are described in the Burchette U.S. Letters Pat. Nos., 3,827,652 and D231,941.

DESCRIPTION OF THE PREFERRED EMBODIMENTS

Figure 1:
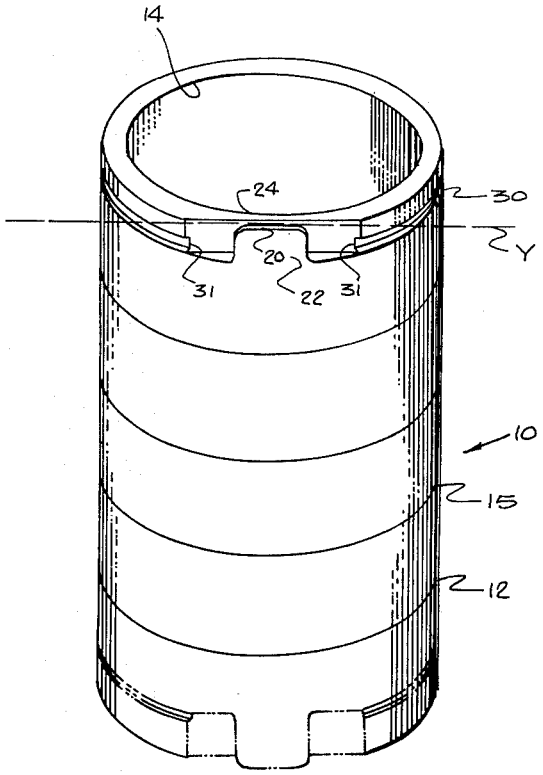
FIG. 1 is an isometric view of a yarn carrier according to the present invention.
Figure 2:
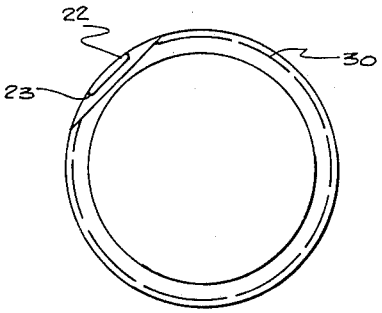
FIG. 2 is an end view of the yarn carrier as illustrated in FIG. 1.

Referring to the Figures, preferred embodiments of the present invention will now be described in detail. In FIGS. 1 and 2 there is shown a tubular cylinder generally indicated as 10 having an outer cylinder wall 12 and an inner cylinder wall 14. Located along the length of outer side wall 12 are a plurality of grooves, ridges or the like 15 that serve as restraint means to prevent initial wraps of yarn from sloughing off an end of tube 10. Anti-sloughing means 15 may thus be represented by a small number of grooves as illustrated in FIG. 1, by a plurality of grooves extending almost entirely along the length of outer side wall 12, by a roughened, sand blasted or knurled surface or the like.

Tube 10 is provided with at least yarn receiving area 20, illustrated as a slot to receive yarn therein for initiation of production of the yarn package. Slot 20 may be located at one or both ends of tube 10 and has been provided by a cut along a short arc through the end of tube 10 that is generally transverse to the length of the tube. Slot 20 is thus defined by an outer element or post 22 around which yarn may pass freely due to smooth radiused surfaces 23, and an uninterrupted inside wall surface 24, whereby a straight slot is produced across a portion of the circumference of tube 10. Yarn Y can thus pass in a direct, unimpeded fashion through slot 20 until it becomes desirable to start winding yarn Y around tube 10. As mentioned above, corners 23' of outer post or element 22 are rounded to lessen the danger of damage to yarn coming into contact therewith as the yarn passes through slot 20 and primarily to permit yarn Y to pass freely therearound when tube 10 and yarn Y received in slot 20 are pulled out of the yarn path between the feed rolls and suction system (not shown). Tube 10 further in a preferred arrangement has a transfer tail receiving groove 30 located adjacent a bottom of slot 20 that extends circumferentially around tube 10. Note particularly in FIG. 1 that groove 30 extends into slot 20 at points 31 to permit direct communication between slot 20 and groove 30 such that yarn in slot 20 automatically passes into groove 30 at initiation of the yarn package. A further slot and groove arrangement is shown in phantom on the lower end of tube 10. According to the present invention, the yarn receiving area may be provided on both ends of the yarn carrier. Yarn receiving areas on both ends of the carrier avoids the necessity of orientation of the carrier prior to use.

Figure 3:
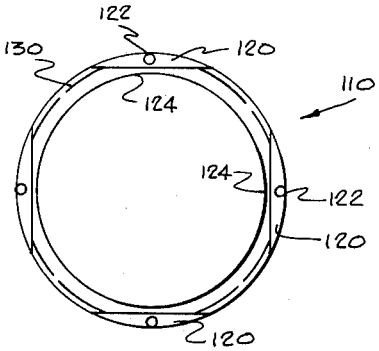
FIGS. 3 and 4 are end views of yarn carriers illustrating further embodiments of the present invention.

In FIG. 3, a yarn tube 110 is illustrated having a plurality of yarn receiving areas or slots 120 located around the circumference of the end of same. Each slot 120 as illustrated is defined by a post 122 and a rear wall 124. Note that posts 122 as shown in FIG. 3 are cylindrical in nature as opposed to an oblong configuration as illustrated in FIGS. 1 and 2 and likewise will permit free passage of yarn thereacross. With the plurality of slots 120 as shown in tube 110 of FIG. 3, the chances of snaring a yarn passing along the path between the feed rolls and the waste suction system are improved. A transfer tail receiving groove 130 is provided around tube 110 in line with the slots 120 adjacent the bottom of same, and is in direct communication with the slots.

Figure 4:
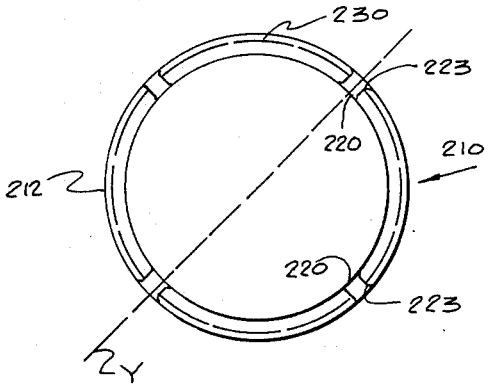

A further embodiment of the present invention is shown in FIG. 4 wherein a tube 210 is provided having a plurality of cuts or notches 220 through the end of tubular wall 212. Cuts 220 on opposite sides of tube 210 cooperate to produce a yarn receiving slot therebetween, as illustrated by a yarn Y extending across tube 210 in cuts 220. As with the structure shown in FIGS. 1 to 3, a transfer tail receiving groove 230 is provided adjacent the bottom of cuts 220 such that yarn automatically passes from the bottom of cuts 220 into the transfer tail receiving groove. Also while four cuts 220 are illustrated in FIG. 4, a different number of cuts could be provided. In each of the cuts 220, the edges 223 are radiused and smooth to permit the free passage of yarn thereover as discussed hereinbefore.

Figure 5:
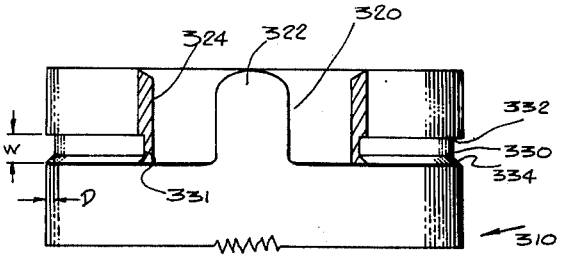
FIG. 5 is a partial side elevational view of a yarn carrier as shown in FIG. 1, illustrating a preferred transfer tail groove.

FIG. 5 illustrates further embodiments of the present invention. A portion of a tube 310 is shown wherein a slot 320 is defined by a cylindrical type post 322 and portions of the tube wall. Rear wall 324 has been removed adjacent slot 320 and the ends 325 of tube wall 312 provide yarn contact points that cooperate with post 322 to define the path of slot 320. A transfer tail receiving groove 330 is located adjacent the bottom of slot 320 and automatically receives yarn from slot 320 to produce the transfer tail. Groove 330 preferably has a width dimension W extending along the tube 310 that is greater than its depth D, such that a plurality of wraps of yarn may be easily received therein to produce a sufficient transfer tail. Note further that a side wall 332 of groove 330 adjacent the yarn entrance is straight or perpendicular with respect to the surface of the tube. Yarn in groove 330 is thus impeded from easily sloughing out of groove 330. Conversely, an opposite side wall 334 of groove 330 is beveled or tapered to foster unwinding of the transfer tail from the tube when desired. Note also at points 331 around transfer tail groove 330 that groove 330 is in direct communication with slot 320 to provide unimpeded passage of yarn from slot 320 therein.

Figure 6:
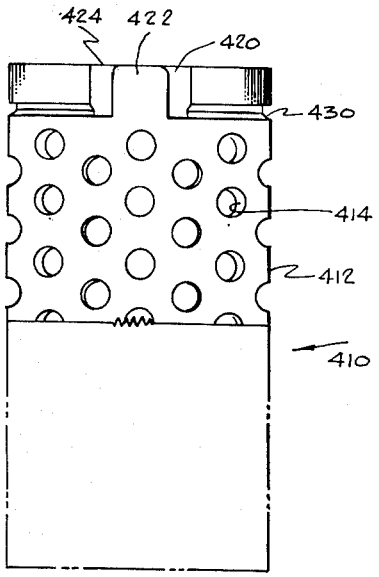
FIGS. 6 and 7 illustrate yarn dye tubes having the teachings of the present invention incorporated therewith.

FIG. 6 illustrates a portion of a yarn dye tube 410 that is employed to dye a yarn wound therearound. Tube or carrier 410 has a wall 412 with a plurality of perforations 414 provided along the length thereof. Perforations 414 permit dye liquor to pass from within the package outwardly to realize better dye uniformity through the yarn package. An end of dye tube 410 has a yarn receiving area or slot 420 for initiation of production of the yarn package. Yarn receiving slot 420 is defined by a post 422 and a back wall 424. Further, a transfer tail receiving groove 430 is located adjacent the bottom of slot 420 for the production of a transfer tail therein.

Figure 7:
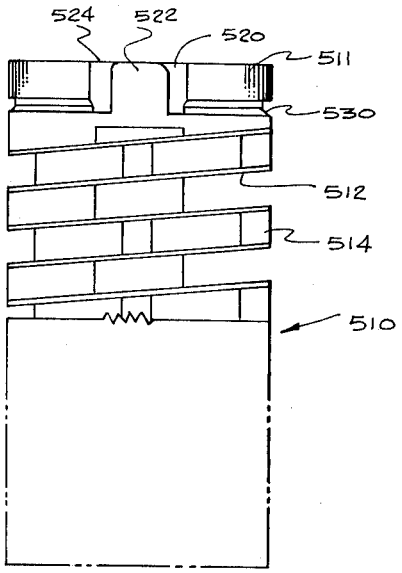

FIG. 7 shows a collapsible yarn dye tube 510 having a pair of end flanges 511 (only one shown) with one or more leads 512 extending in helical fashion therearound. Axial compression limiting means 514 are spaced between turns of the same lead or between adjacent leads in the case of a plurality of same. Use of this type carrier permits collapse of same in the dye vat to increase the dyeing capacity of the vat. At an end of the collapsible tube 510 is a yarn receiving slot 520 that is defined by a post 522 and a rear wall 524. Likewise, a transfer tail receiving grooves 530 is located adjacent the bottom of slot 520 in the fashion as has been described hereinbefore.

Figure 8:
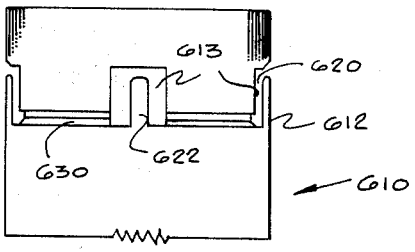
FIG. 8 illustrates a further embodiment of the yarn receiving area on a yarn carrier according to the present invention.

In FIG. 8 a yarn receiving area 620 is located along the length of a yarn carrier 610 as opposed to at an end as described in FIGS. 1 through 7. A flat 613 is cut into side wall 612 of tube 610, leaving a post 622 therealong. Yarn can thus be snared between flat 613 and post 622, while freely passing around post 622 until it is desirable to initiate the wind around tube 610. A transfer tail receiving groove 630 is located adjacent the bottom of yarn receiving area 620.

The yarn carriers of the present invention are preferably injection molded from a thermoplastic polymeric material, preferably a polyethylene or polypropylene. It should be understood, however, that metallic tubes, fiber tubes or paper tubes could likewise be employed with the features of the present invention incorporated thereon. The various embodiments of the present invention illustrated herein have been discussed with respect to certain arrangements on a particular yarn carrier. The embodiments are, however, interchangeable whereby any particular embodiment can be incorporated into a carrier having one or more of the other embodiments thereon.

In operation, a tube is brought into the yarn path between the feed rolls and the waste suction system where the yarn is received in the yarn receiving area. The tube is rotated into position to be received by a chuck and into contact with a drive roll while the yarn continues to pass through the yarn receiving area without any undue restraint. As the tube contacts the drive roll and begins to rotate, yarn in the yarn receiving area passes into the transfer tail groove, and yarn from within the waste suction system is withdrawn and wound in the transfer tail groove to produce the transfer tail. As soon as the tail is produced, the yarn from the suction system is severed, and conventional production of the package proceeds.

Having described the present invention in detail, it is obvious that one skilled in the art will be able to make variations and modifications thereto without departing from the scope of the invention. Accordingly, the scope of the present invention should be determined only by the claims appended hereto.

What is claimed is:

1. An improved yarn carrier comprising a tubular, open ended cylindrical body, said body having at least one yarn receiving slot extending axially therealong, said slot being sized to permit a yarn to pass freely therethrough, said body further having a circumferentially extending groove located at the base of said slot and communicating directly with said slot to receive a yarn transfer tail therein, said groove being defined by a sloped inner wall with respect to a nearest adjacent end of said carrier, an outer wall with respect to said nearest adjacent end of said carrier that is generally perpendicular to a peripheral surface of said body, and a bottom wall connecting said inner and outer walls and defining a yarn receiving surface, said groove having a height greater than the depth from the peripheral surface of the body to the yarn receiving surface.

2. An improved yarn carrier as defined in claim 1 wherein the at least one yarn receiving slot is cut along an arc, leaving an inside surface of the body side wall uninterrupted.

3. An improved yarn carrier as defined in claim 1 wherein the body further comprises a plurality of perforations spaced along the length of same.

4. An improved yarn carrier as defined in claim 1 wherein the body is solid along the length of same.

5. An improved yarn carrier as defined in claim 1 wherein the body comprises opposite end flanges and at least one compressible helical member secured therebetween, said helical member having axial compression limit means secured thereto.

6. An improved yarn carrier as defined in claim 1 where said slot is located at said end of said carrier.

7. An improved yarn carrier as defined in claim 1 wherein said slot is located away from said end along the side of said body.

* * * * *